US007357074B2

(12) United States Patent
Kraft et al.

(10) Patent No.: US 7,357,074 B2
(45) Date of Patent: Apr. 15, 2008

(54) COMPRESSION SCREW WITH COMBINATION SINGLE AND DOUBLE FLIGHTS

(75) Inventors: Michael J. Kraft, Montoursville, PA (US); Joseph L. Keller, South Williamsport, PA (US); Anthony M. Riotto, Barnesville, PA (US)

(73) Assignee: Andritz Inc., Glens Falls, NY (US)

( * ) Notice: Subject to any disclaimer, the term of this patent is extended or adjusted under 35 U.S.C. 154(b) by 115 days.

(21) Appl. No.: 11/330,562

(22) Filed: Jan. 11, 2006

(65) Prior Publication Data

US 2006/0196370 A1 Sep. 7, 2006

Related U.S. Application Data

(60) Provisional application No. 60/658,250, filed on Mar. 2, 2005.

(51) Int. Cl.
*B30B 9/14* (2006.01)

(52) U.S. Cl. ..... 100/117; 100/145; 210/413

(58) Field of Classification Search ..... 100/104, 100/110, 112, 117, 125, 126, 127, 128, 131, 100/138, 144–150; 99/495, 458, 465; 210/413, 210/415, 770; 425/208, 209; 366/83–85, 366/88, 89, 323

See application file for complete search history.

(56) References Cited

U.S. PATENT DOCUMENTS 3,892,173 A * 7/1975 Hall et al. ..... 100/117
4,581,992 A * 4/1986 Koch ..... 100/117
5,516,427 A * 5/1996 Yoshikawa ..... 210/413
6,550,376 B2 * 4/2003 Johnston ..... 100/146

FOREIGN PATENT DOCUMENTS

JP 59166396 A * 9/1984
NZ 299161 8/1998

* cited by examiner

*Primary Examiner*—Jimmy T. Nguyen
(74) *Attorney, Agent, or Firm*—Alix, Yale & Ristas, LLP

(57) ABSTRACT

A screw for a compression dewatering device comprising an elongated shaft having axially spaced apart first and second ends, a conveying section at the first end of the shaft, having a single helical screw flight rigidly projecting from the shaft, a flightless transition section axially adjacent the conveying section, and a dewatering section axially adjacent the transition section, having a double helical screw flight rigidly projecting from the shaft. Another embodiment is a compression screw with similar characteristics having a perforated tubular dewatering wall intermediate the ends, followed by an imperforate spool wall at the discharge end. A gravity feed device is operatively associated with the inlet end of the screw shaft for depositing bulk solids material through the feed opening onto the conveying screw, and a drive system is operatively connected to the inlet end of the screw for rotating the screw in the housing.

25 Claims, 5 Drawing Sheets

COMPRESSION SCREW WITH COMBINATION SINGLE AND DOUBLE FLIGHTS

RELATED APPLICATION

This application claims the benefit under 35 U.S.C. Sec. 119(e), of the filing date of U.S. Provisional Application No. 60/658,250 filed Mar. 2, 2005, for "Compression Screw With Combination Single and Double Flights".

BACKGROUND OF THE INVENTION

The present invention relates to the dewatering of wood byproducts to produce a furnish for a mechanical refiner or chemical digester, for conversion of fibers into pulp.

The purpose of a dewatering compression screw device in the overall processes of greatest interest, production of fiberboard (MDF), particleboard (PB), or thermomechanical pulp (TMP), is to remove fluids (extractives) from the raw material and form a pressure plug prior to entry of the dewatered material into the digester or refiner. The raw material is typically sawdust, wood shavings, or wood chips, which are generally considered bulk solids. No pre-processing is required before dewatering, except for washing or pre-steaming. In MDF or PB processes, an air dryer is typically provided after the refiner, and measurement of the heat or energy required for a target dryness of the refined material (dryer load), is an inverse measure of the effectiveness of the dewatering device upstream of the refiner. Even when no active drying is performed downstream of the dewatering device, the energy efficiency of the main process can be correlated with the effectiveness of the dewatering. In the TMP process, the extractives to be removed from the raw material source contribute to darkening of the final product. Removal of extractives may thus yield a reduction in the amount of bleaching chemicals necessary to produce the desired brightness.

For many years, efforts have been made to increase the dewatering effectiveness on the feed material, and thereby reduce the overall energy or chemical costs, especially for the final drying or bleaching stages. This has typically been characterized by reducing variations in the initial moisture content (arising for example, from storage conditions and seasonality), and increasing the compression ratio in the dewatering section of the screw device. Typical devices are as described in U.S. Pat. No. 5,320,034 and International publication WO 92/13710, the disclosures of which are hereby incorporated by reference. In this context, compression ratio (CR) is defined as the cross sectional area of the inlet versus the cross sectional area of the outlet of the dewatering device.

Dewatering of bulk solid materials has been particularly difficult. Whereas dewatering of pulp slurries having a consistency in the range of 4-5 percent is relatively easy, dewatering of bulk materials having a consistency greater than 25 percent, has posed problems. These problems arise from the difficulties in managing the relative friction among the screw shaft, screw flights, and compression housing wall. In particular, it is desirable that the friction in the axial direction be lower than the friction in the tangential direction along the wall, such that the material as influenced by the screw flights will be transported axially as well as compressed, rather than remaining between particular flights and rotating with the screw.

It is also known that when very high compression ratios are desired, single flight screws have inherent unbalanced loads and reach a point of diminishing returns whereby a given increment of applied energy (in the form of increased torque on the screw) produces very little benefit in the way of further dewatering. Thus, single flight screws are suitable for low consistency feed material, or only modest levels of compression of bulk solids. Double flight screws are known for use in higher compression environments, especially for bulk solids. Double flight screws, however, have required forced feeding, such as described in U.S. Pat. No. 5,320,034, thereby adding another drive device and increasing the total energy required for a given level of dewatering.

SUMMARY OF THE INVENTION

The present invention is directed to a new screw, and a new dewatering device incorporating such screw, whereby higher levels of dewatering and reliability are achieved with the same screw drive energy consumption as is used in conventional devices.

In one preferred aspect, the invention is directed to a compression dewatering screw comprising an elongated shaft having axially spaced apart first and second ends, a conveying section at the first end of the shaft, having a single helical screw flight rigidly projecting from the shaft, a flightless transition section axially adjacent the conveying section, and a dewatering section axially adjacent the transition section, having a double helical screw flight rigidly projecting from the shaft.

In another preferred aspect, the invention is directed to a screw for mounting in a compression screw dewatering device having a housing, an inlet end, a discharge end, and a drive for rotating the screw within the housing. The screw comprises a central shaft having inlet and discharge ends for mounting at the inlet and discharge ends of the housing, a conveying section at the inlet end of the shaft, having a single helical screw flight rigidly projecting from the shaft, and a dewatering section adjacent the discharge end of the shaft, having a double helical screw flight rigidly projecting from the shaft. A flightless transition section is situated between the conveying section and the dewatering section.

In another aspect, the invention is directed to a compression screw dewatering device comprising an elongated housing having an inlet end and a discharge end along a housing axis. The housing includes an axially extending, perforated tubular dewatering wall intermediate the ends, followed by an imperforate spool wall at the discharge end. The screw coaxially extends along the housing axis, and includes a central shaft having inlet and discharge ends rotatably supported at the inlet and discharge ends of the housing, a conveying section extending axially from the inlet end of the shaft, having a single helical screw flight rigidly projecting from the shaft, a flightless plug section extending axially from the discharge end of the shaft, within the spool wall, and a dewatering section adjacent the plug section, having a double helical screw flight rigidly projecting from the shaft. A flightless transition section is situated between the conveying section and the dewatering section. A gravity feed device is operatively associated with the inlet end for depositing bulk solids material through the feed opening onto the conveying screw, and a drive system is operatively connected to the inlet end of the screw for rotating the screw in the housing.

As is well known for dewatering devices, the effective flow area between the housing wall and the dewatering section of the screw shaft decreases toward the discharge end. In a further aspect of the preferred embodiment, irregularities or projections are provided at the wall of the dewatering section, for producing a greater resistance to tangential flow along that wall than to axial flow along that wall.

The significantly improved dewatering effectiveness of the invention is likely attributable to the synergy achieved by combining the best attributes of a single flight screw with the best attributes of a dual flight screw, while assuring an effective transition between them. A single flight would produce an unbalanced radial pressure wave (viewing the dewatering section in an axial cross section). The unbalanced wave forces the screw into an orbit as opposed to staying centered within the housing. As the compression ratio is increased on the single flight screw, power is consumed in deflection and orbit of the screw, at the expense of processing of material. A double flight has a balanced pressure wave and thus no orbit from deflection. The ability to handle the increased compression ratio results in a direct process benefit relative to single flight screws. However, a number of inexplicable feed forward problems can arise, particularly production rate variation, production loss, output consistency variation, and reduction of plug holding (pressure seal) capacity. The root cause of this is not obvious, but through significant insights the present inventors now realize that the problem was rotation of material in the inlet section of the device.

The hybrid single/double flight design of the present invention inherently solves the feed forward problem and the high compression ratio problem. In the inlet zone, a single flight accepts feed material deposited by gravity, and conveys the material axially forward. In the compression zone a double flight achieves high CR without deverting the energy into deflection and orbiting of the shaft. A flightless transition section, evenly distributes the material to the dual flight section, and also imparts a beneficial pressure wave.

BRIEF DESCRIPTION OF THE DRAWING

The preferred embodiment will be described below with reference to the accompanying drawing, in which.

DESCRIPTION OF THE PREFERRED EMBODIMENT

Figure 1:
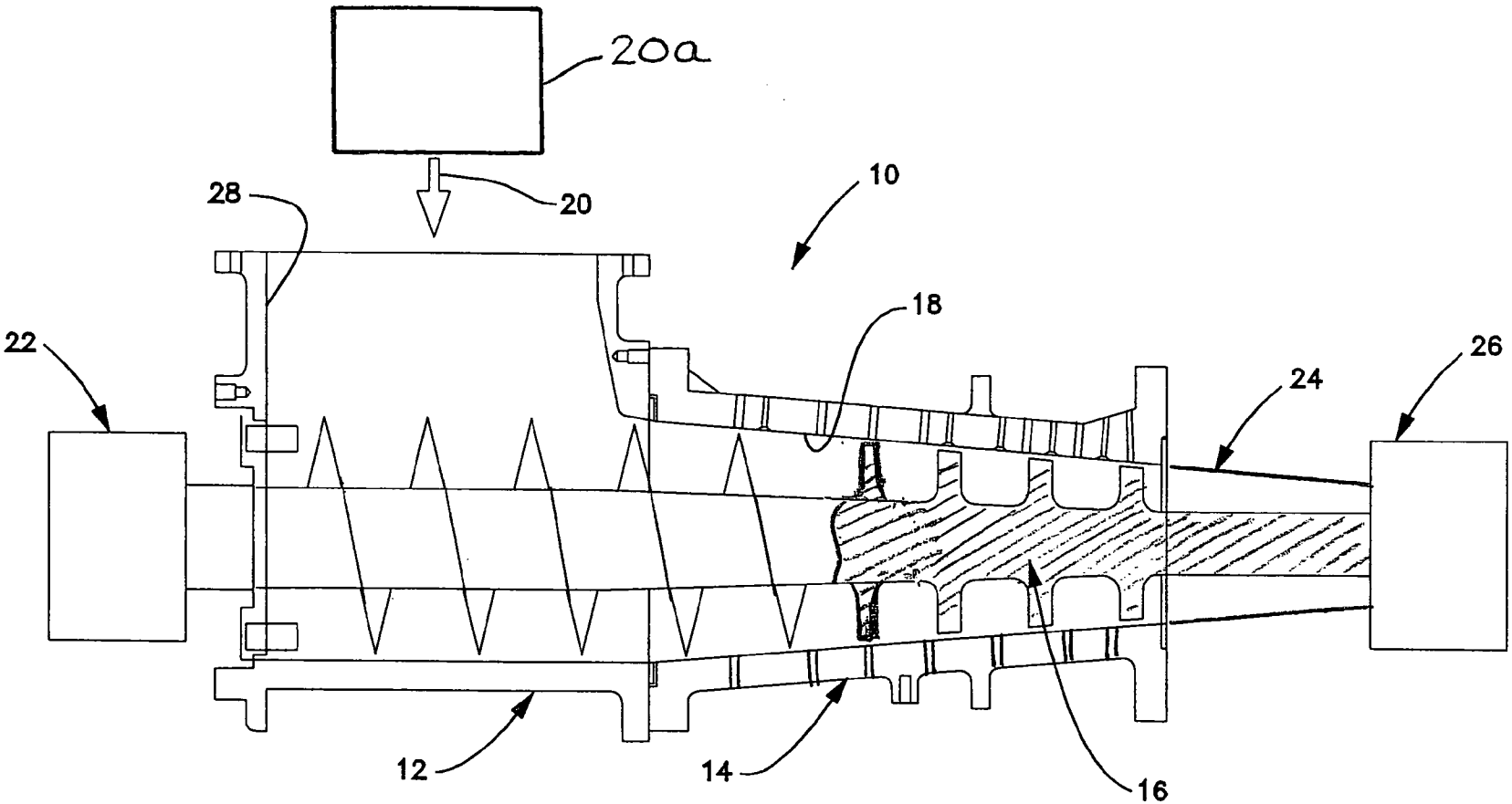
FIG. 1 is longitudinally sectioned view of a compression screw dewatering device according to one aspect of the invention.

FIG. 1 is a partially sectioned longitudinal view of the dewatering device 10 with associated components in accordance with one embodiment of the invention. The dewatering device 10 comprises one, two, three, or more physical housing sections that are rigidly connected together end-to-end to form a substantially tubular housing. For example, a feed section 12 forms a hopper, which is followed by a compression section 14. The feed section is sometimes perforated to allow free water to drain, but is not active for compression drainage. Functionally, feed material is received in the feed zone of the hopper and conveyed to the dewatering zone of the compression section. The functional zones are defined primarily by the relationship between a central screw 16 and the inside wall 18 of the surrounding housing. The screw has inlet and discharge ends mounted for rotation within the housing.

The conveying or feed section at the inlet end of the screw receives feed material deposited from gravity feeding device 20*a* by gravity flow 20 into the hopper opening 28 formed in the feed section 12 of the housing. In a conventional manner, a drive system, such as a motor 22, is mounted at the end face of the feed section 12, for engagement with a coupling at inlet end of the screw. The material is conveyed by the single helical flight of the screw. The flight has a uniform pitch (which is the distance from crest to crest), and preferably extends axially for at least about two pitches.

The compression section 14 is secured to the inlet section, and has a substantially conical, decreasing taper of the inner wall 18, in the material transport direction. Thus, in the compression section, the effective cross sectional flow area decreases in the transport direction, thereby compressing the material such that water and other extractive are squeezed out of the material and pass through the housing wall via any of a variety of available holes or other perforations through the housing wall.

Figure 2A:
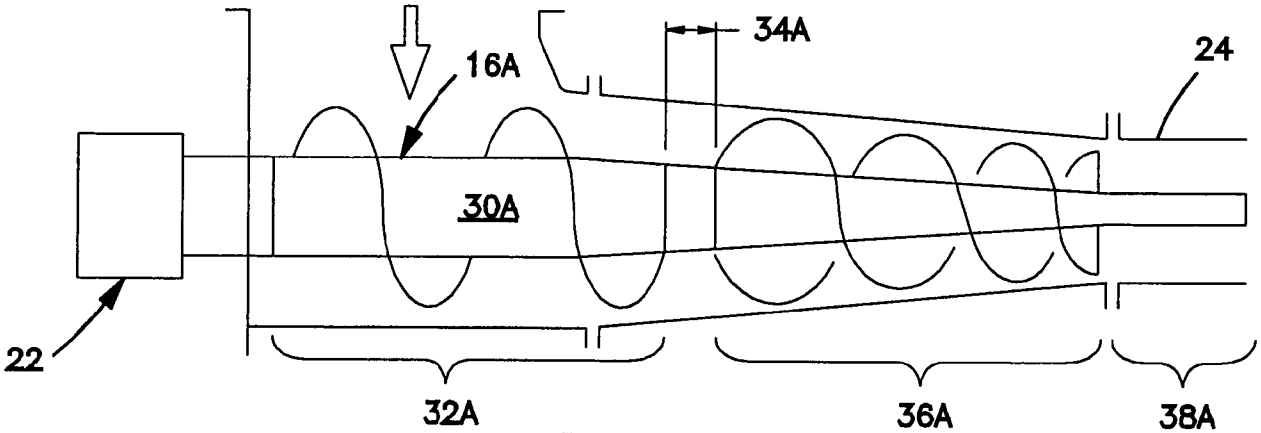
FIGS. 2A and B are a schematic representations of the relationship of the inventive screw to the compression housing for a tapered housing, and for a straight housing with tapered screw shaft, respectively.
Figure 2B:
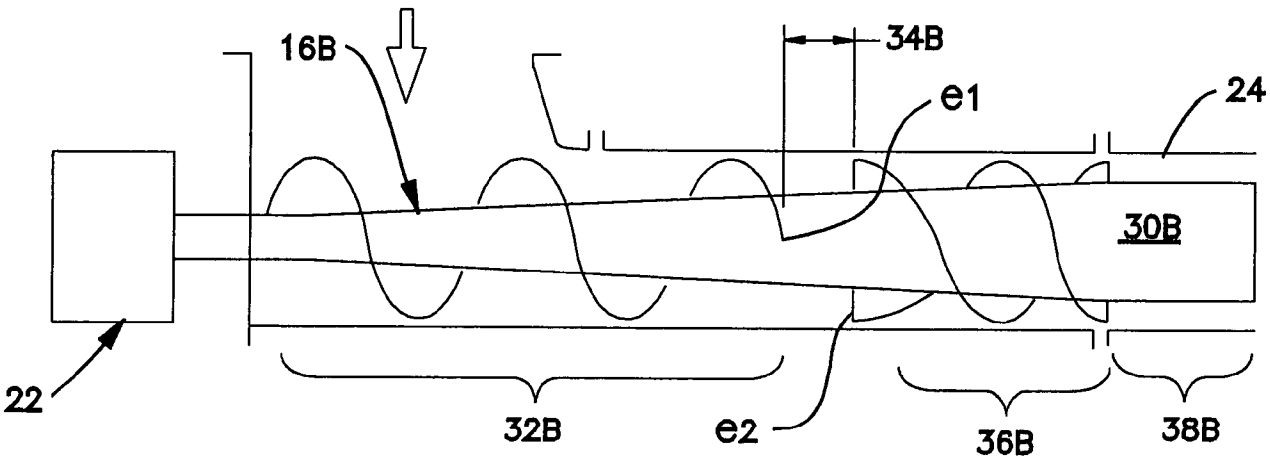

FIGS. 2A and B are more detailed views of the preferred forms of the screw 16 in the context of alternative compression section designs A and B. The screw has a central shaft 30A, 30B defining a screw axis. The inlet end of the shaft is adapted for mating with the drive system 22, and the discharge end of the shaft is adapted for entry into the spool section 24 of the housing. It can be appreciated that the screw is substantially coaxially mounted within the housing for rotation therein, driven by the drive system. A single flight screw formation 32A, 32B rigidly projects from the shaft along the axial extent of the feed section of the housing, and preferably up to about one flight pitch into the compression section housing where initial compression and some dewatering occur between the flight and the housing wall. This initial compression in essence consolidates the material as a result of either the housing wall taper of a tapered housing (alternative A) or the outward taper of the screw shaft within the cylindrical wall of a cylindrical housing (alternative B). Preferably, the taper angle at the entry into the compression housing of alternative A is greater than the overall taper angle along the perforated walls of the compression housing.

The conveying screw flight ends abruptly, preferably with an edge $e_1$ that is substantially radial relative to the shaft axis. For an axial distance corresponding to at least about one eighth of a flight pitch, the shaft has no screw flight. This flightless section 34A, 34B can be considered a transition between the primarily conveying section of the screw and the primarily dewatering section of the screw. Typically, the axial extent of the transition section 34A, 34B should be at least about one inch (2.5 cm).

In the dewatering section 36A, 36B, the shaft carries a double flight, wherein each flight rigidly projects as a helix having the same or different pitch than the single flight, but the double flights are 180 degrees out of phase with each other. Preferably, the flights in this section traverse the shaft for at least two full pitches, i.e., at least 720 degrees. At the end of the transition section, each of the double flights has an abrupt leading edge $e_2$ that is substantially radial with respect to the shaft axis. The double flights are preferably at least about 45 degrees out of phase with the single, conveying flight.

As shown in the screw portion 16 visible in FIG. 1, in the compression section with a longitudinal section line taken along the shaft axis, a sectioned portion of one flight of the double helix is balanced against an equal and opposite sectioned portion of the other flight.

Between the compression section and the discharge end, the screw is unflighted 38A, 38B and is surrounded by the spool 24, which may be integral with the compression section of the housing, or attached thereto as a separate spool section. The dewatered material forms a pressure plug in the spool section, which advances along the shaft until it is discharged into a discharge chamber or housing 26 (see FIG. 1), typically at atmospheric pressure where the material rapidly expands before for further processing.

Figure 3:
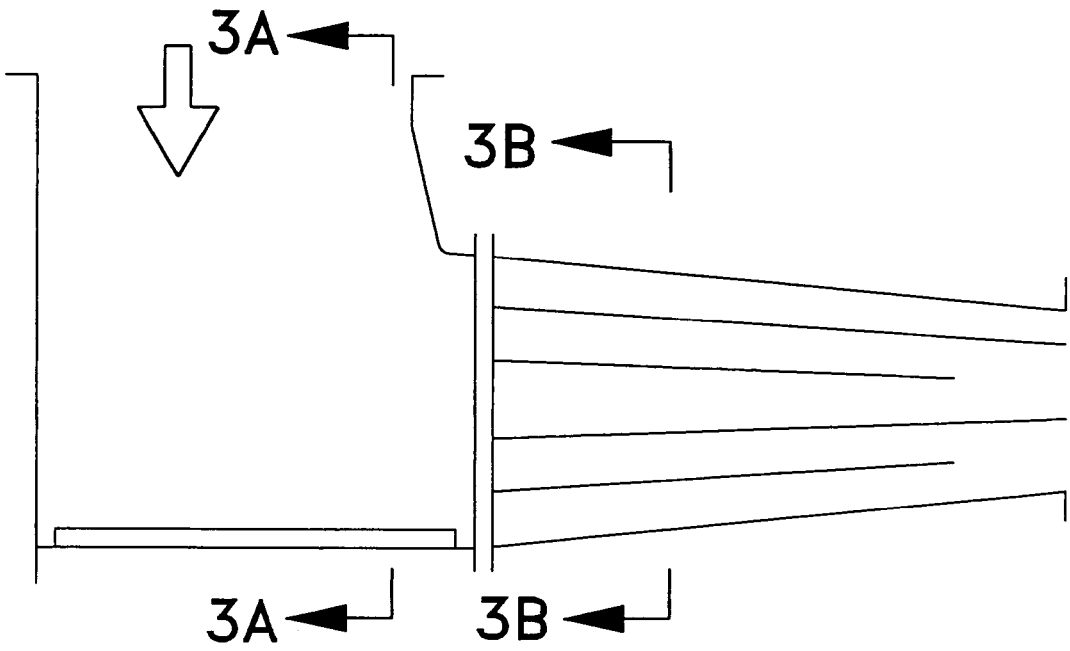
FIGS. 3, 3A, and 3B are schematic representations of the inlet hopper and compression housing, with associated cross section views showing optional anti-rotation bars projecting from the lower wall of the hopper and from the wall of the compression housing, respectively.
Figure 3A:
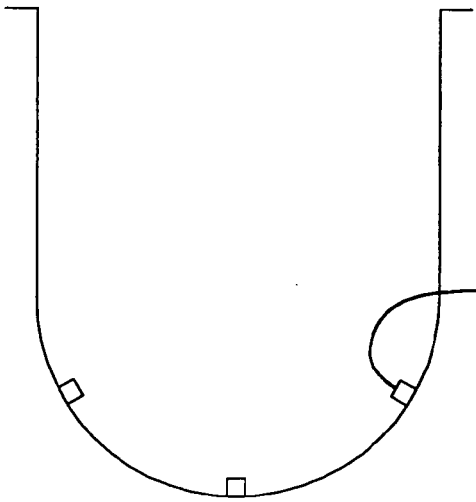
Figure 3B:
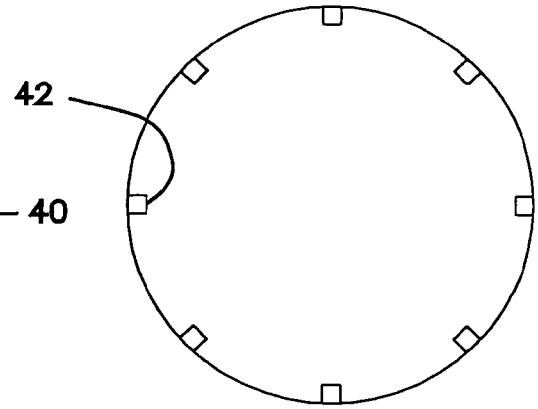

As shown in FIG. 3, anti-rotation structure, such as longitudinally extending bars, can be provided at one or more locations at the wall of the housing. Section A-A shows anti-rotation bars 40 in the lower, concave wall of the inlet section of the housing. In particular, anti-rotation bars 42 are preferably provided at the entry into the compression housing as shown at B-B and at the wall of the housing surrounding the transition section of the screw. As is well known in this field, bars, pegs, dimples, and other techniques can be used for anti-rotation. The anti-rotation bars, the sharp edges of the screw flights at the entry and exit of the transition section, and the dual, diametrically opposed entry of material into the dewatering section, produces an overall uniformity of material consistency into the dewatering section. This enhances the forward movement of the material, preventing excessive build-up or caking of material in the feed section of the housing and in the transition zone. This also assures the overall balance of material mass and compression forces acting on the shaft and the flights as the material is dewatered. Compression ratios of 4:1 or more can be achieved in this manner.

Figure 4:
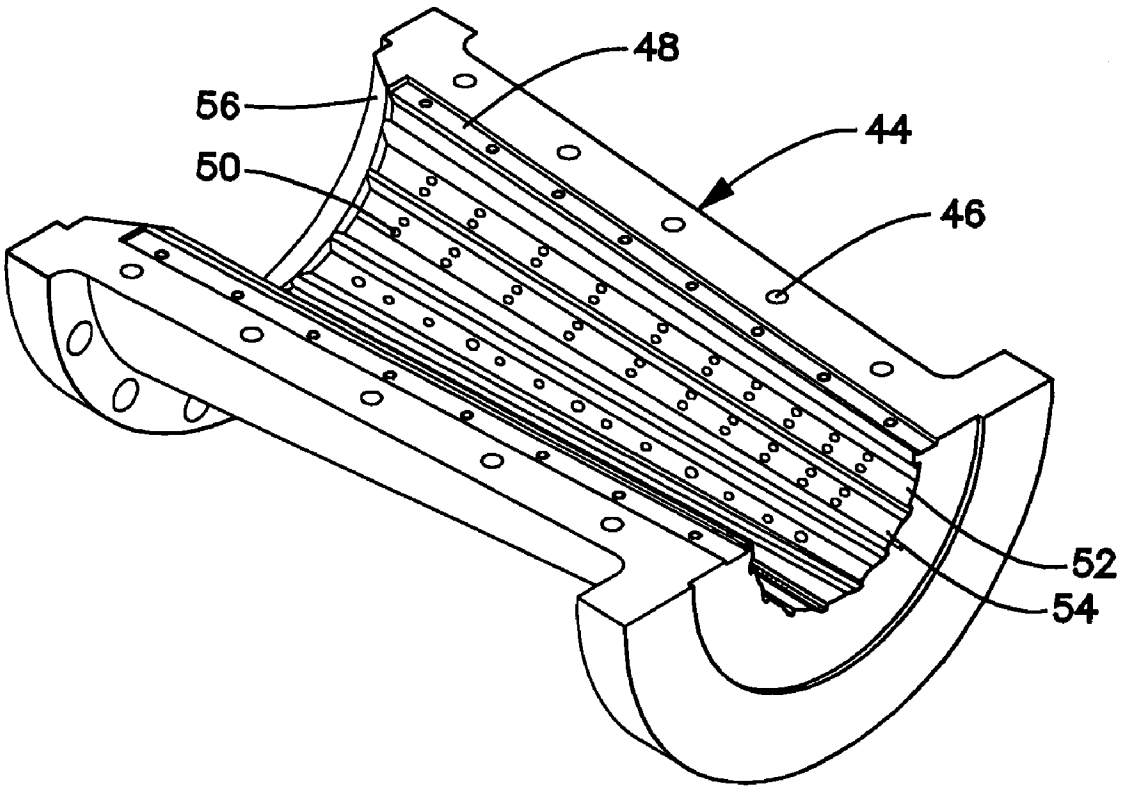
FIG. 4 is a perspective view of one half shell of a two-part compression housing, showing the perforations for extraction of liquid and irregular interior wall surface for increasing tangential friction.
Figure 5:
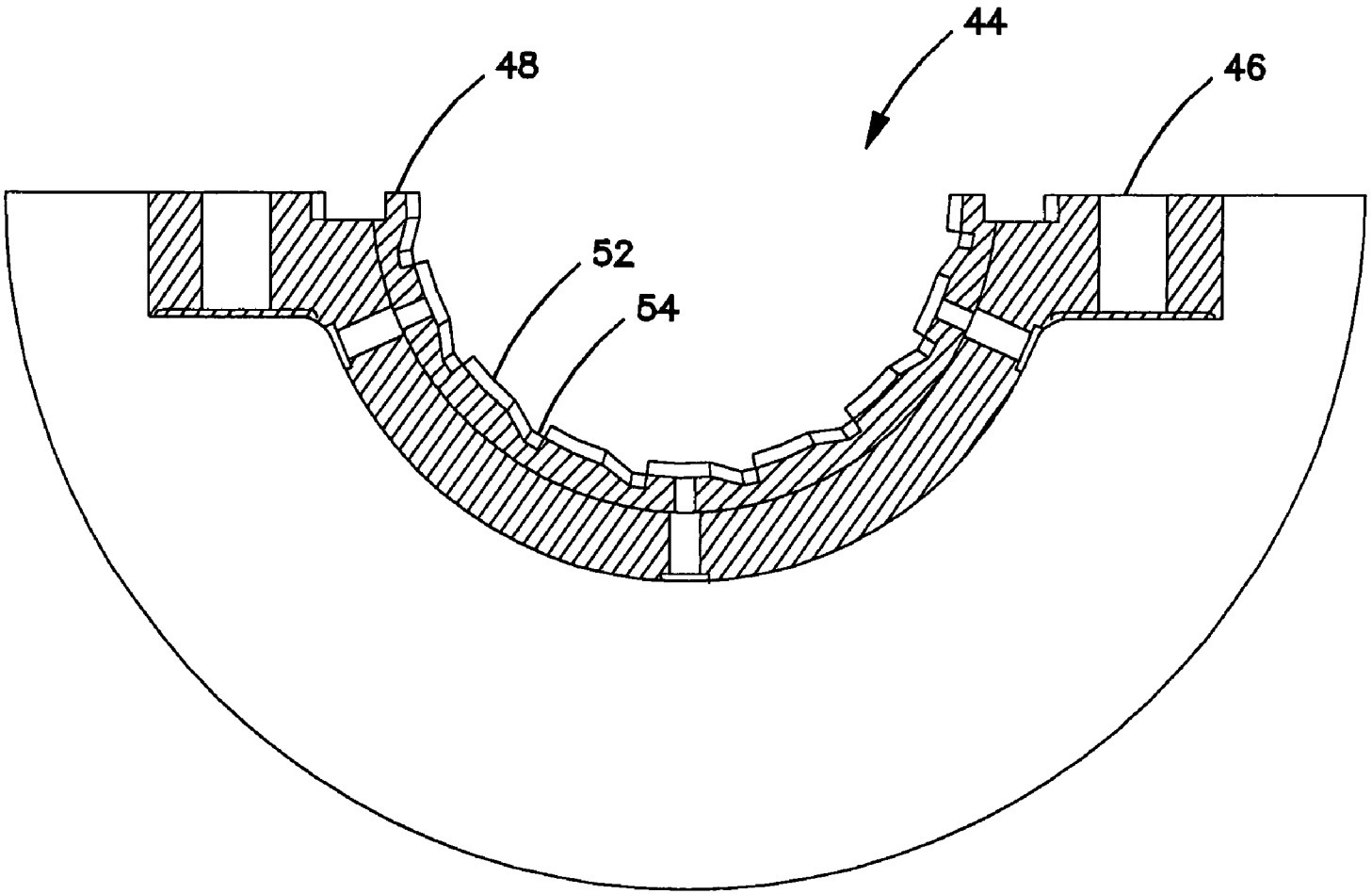
FIG. 5 is a cross section view of the compression housing shell of FIG. 4.

FIG. 4 is an illustration of one half-shell 44 of a tapered compression dewatering housing such as shown schematically in FIG. 2A. Two such half-shells are secured together with bolts spanning opposed holes 46, in a known manner. The compression housing preferably includes a conical liner 48, serving as the inner wall, which has a multiplicity of perforations 50 for collecting the extractive for removal to a collection point, in a manner well known in this field of technology. In the illustrated embodiment, the liner has a bar 52 and groove 54 structure which provides an anti-rotation functionality, as well as facilitating drainage. The preferred sharp angle of entry relative to the angle of the remainder of the compression housing is evident at 56. A cross sectional view of one housing half-shell is shown in FIG. 5, with the fluid extraction holes omitted for clarity.

The invention has been described in the preferred context of dewatering bulk solids. However, the novel screw having a combination of a single flight associated with infeed and initial conveyance, and a double flight associated with dewatering, can be advantageously utilized with a variety of housings to dewater a variety of materials, including low consistency slurries. Such screw is especially suitable for back fitting into existing dewatering devices, because the overall size and envelope of the flight crests of the original screw, can be easily designed into the inventive replacement screw. Even if no change is made to the drive system, higher compression and improved dewatering will be achieved for the same energy consumed for driving the screw.

The invention claimed is:

1. A screw for mounting in a compression screw dewatering device comprising:

an elongated shaft having a longitudinal axis and having axially spaced apart first and second ends;

a conveying section at the first end of the shaft, having a single helical screw flight rigidly projecting from the shaft;

a flightless transition section having an axial length located axially adjacent the conveying section; and a dewatering section axially adjacent the transition section, having double helical screw flights rigidly projecting from the shaft the double helical screw flights of the dewatering section comprise a first flight extending for at least two revolutions along the shaft axis with a first pitch and a second flight extending for at least two revolutions along the shaft axis with a second pitch substantially equal to the first pitch and 180 degrees out of phase with the first flight;

wherein the flight in the conveying section has a phase difference of at least 45 degrees relative to the flights in the dewatering section.

2. The screw of claim 1, wherein the flight in the conveying section extends axially along the shaft for at least about two revolutions.

3. The screw of claim 1, wherein the flight in the conveying section has a uniform pitch and extends axially for at least about two pitches along the shaft.

4. The screw of claim 1, wherein the axial length of the transition section is greater than 25 mm (one inch).

5. The screw of claim 1, wherein the flight in the conveying section has a pitch and the transition section has a length of at least one-eighth of the conveying section pitch.

6. The screw of claim 1, wherein the flight in the conveying section has a terminal edge that is substantially radial relative to the shaft axis, and the flights of the dewatering section have leading edges that are substantially radial relative to the shaft axis.

7. The screw of claim 1, including a flightless plug section axially adjacent the dewatering section and extending to the second end of the shaft.

8. The screw of claim 1, wherein the flight in the conveying section extends axially along the shaft for at least about two revolutions;

the axial length of the transition section is greater than 25 mm (one inch); and the flight in the conveying section has a terminal edge that is substantially radial relative to the shaft axis, and the flights of the dewatering section have leading edges that are substantially radial relative to the shaft axis.

9. A screw for mounting in a compression screw dewatering device having a housing, an inlet end, a discharge end, and a drive for rotating the screw within the housing, wherein the screw comprises:

a central shaft extending along a longitudinal axis and inlet and discharge ends to be located at the inlet and discharge ends of the housing, respectively;

a conveying section at the inlet end of the shaft, having a single helical screw flight rigidly projecting from the shaft;

a flightless plug section at the discharge end of the shaft;

a dewatering section adjacent the plug section of the shaft, having double helical screw flights rigidly projecting from the shaft the double helical screw flights of the dewatering section comprise a first flight extending for at least two revolutions about the shaft axis with a first pitch and a second flight extending for at least two revolutions about the shaft axis with a second pitch substantially equal to the first pitch and 180 degrees out of phase with the first flight, such that for a longitudinal section line taken along the shaft axis, a sectioned portion of the first flight is balanced against an equal and opposite sectioned portion of the second flight, and a flightless transition section between the conveying section and the dewatering section;

wherein the double helical screw flights extend continuously from the transition section to the plug section and the flight of the conveying section has a phase difference of at least 45 degrees relative to the flights of the dewatering section.

10. The screw of claim 9, wherein the length of the transition section is greater than 25 mm (one inch).

11. The screw of claim 9, wherein the flight in the conveying section has a terminal edge that is substantially radial relative to the shaft axis, and the flights of the dewatering section have leading edges that are substantially radial relative to the shaft axis.

12. A compression screw dewatering device for bulk material, comprising:

an elongated housing having an inlet end and a discharge end along a housing axis, the housing including an axially extending, perforated tubular dewatering wall intermediate the ends, followed by an imperforate spool wall at the discharge end;

a screw having a screw axis coaxially extending along the housing axis, including a central shaft having inlet and discharge ends rotatably supported at the inlet and discharge ends of the housing, respectively, a conveying section extending axially from the inlet end of the shaft, having a single helical screw flight rigidly projecting from the shaft, a flightless plug section extending axially from the discharge end of the shaft, within the spool wall of the housing, a dewatering section adjacent the plug section of the shaft, having double helical screw flights projecting from the shaft for cooperating with the perforated tubular dewatering wall to dewater the material and convey the dewatered material to the plug section of the screw, the double helical screw flights of the dewatering section comprise a first flight extending for at least two revolutions along the shaft axis with a first pitch and a second flight extending for at least two revolutions along the shaft axis with a second pitch substantially equal to the first pitch and 180 degrees out of phase with the first flight, wherein the flight of the conveying section has a phase difference of at least 45 degrees relative to the flights in the dewatering section; and a flightless transition section between the conveying section and the dewatering section;

a gravity feed device operatively associated with the inlet end of the housing for depositing bulk solids material through a feed opening onto the conveying section of the screw; and a drive system operatively connected to the inlet end of the screw for rotating the screw in the housing;

whereby (a) feed material is conveyed to the transition section and consolidated therein while urged through the transition section, (b) the consolidated material is distributed substantially equally to the flights of the dewatering section, (c) the material is compressed and dewatered as it passes through the dewatering section, and (d) the dewatered material forms a pressure plug between the plug section of the shaft and the spool wall whereupon the material is discharged from the housing.

13. The dewatering device of claim 12, wherein the conveying section of the screw extends within the perforated wall of the housing and the double helical screw flights extend continuously from the transition section to the plug section.

14. The dewatering device of claim 12, wherein the conveying section of the screw extends within the perforated wall of the housing, and further wherein the housing is inwardly tapered around at least a portion of the conveying section of the screw.

15. The dewatering device of claim 14, including means projecting toward the conveying section of the screw from the housing, for producing a greater resistance to tangential flow of material than to axial flow.

16. The dewatering screw of claim 15, wherein the means projecting toward the conveying section of the screw are situated at said inward taper of the housing.

17. The dewatering device of claim 15, wherein means projecting toward the screw from the housing are situated at an inwardly tapered portion of the housing.

18. The dewatering device of claim 12, wherein the flight in the conveying section extends axially along the shaft for at least about two revolutions;

the axial length of the transition section is greater than 25 mm (one inch); and the flight in the conveying section has a terminal edge that is substantially radial relative to the shaft axis, and the flights of the dewatering section have leading edges that are substantially radial relative to the shaft axis.

19. The dewatering device of claim 18, wherein the conveying section of the screw extends within the perforated wall of the housing.

20. The dewatering device of claim 19, wherein the housing is inwardly tapered around at least a portion of the conveying section of the screw.

21. The dewatering device of claim 20, including means projecting toward the conveying section of the screw from the housing, for producing a greater resistance to tangential flow of material than to axial flow.

22. The dewatering screw of claim 21, wherein the means projecting toward the conveying section of the screw are situated at said inward taper of the housing.

23. The dewatering device of claim 18, including means projecting toward the screw from the perforated wall of the housing, for producing greater resistance to tangential flow of the material than to axial flow of the material through the housing.

24. The dewatering device of claim 18, wherein said means project toward the transition section of the screw.

25. The dewatering device of claim 12, wherein the housing has an open hopper section at the inlet end followed by an inwardly tapered dewatering section having said perforated wall, and said dewatering section has an initial dewatering portion with an initial taper angle immediately following the hopper section that is greater than the taper angle of a main dewatering portion that follows said initial dewatering portion.

* * * * *

UNITED STATES PATENT AND TRADEMARK OFFICE

CERTIFICATE OF CORRECTION

PATENT NO. : 7,357,074 B2
APPLICATION NO. : 11/330562
DATED : April 15, 2008
INVENTOR(S) : Kraft et al.

It is certified that error appears in the above-identified patent and that said Letters Patent is hereby corrected as shown below:

Column 6:

Line 13, after "shaft" insert --,--.

Line 64, after "shaft" insert --,--.

Column 8:

Line 24, after "claim" delete "15" and insert --13--.

Line 56, after "claim" delete "18" and insert --23--.

Signed and Sealed this

Twenty-ninth Day of July, 2008

JON W. DUDAS
*Director of the United States Patent and Trademark Office*